United States Patent [19]

Byrne

[11] Patent Number: 4,872,329

[45] Date of Patent: Oct. 10, 1989

[54] KEY DEVICE AND A DETECTOR DEVICE FOR USE THEREWITH

[76] Inventor: James J. Byrne, Edenderry, Ireland

[21] Appl. No.: 82,845

[22] Filed: Aug. 6, 1987

[30] Foreign Application Priority Data

| | | | |
|---|---|---|---|
| Aug. 8, 1986 | [IE] | Ireland | 2129/86 |
| Aug. 8, 1986 | [IE] | Ireland | 2130/86 |
| Oct. 10, 1986 | [IE] | Ireland | 2681/86 |
| May 22, 1987 | [IE] | Ireland | 1352/87 |
| May 22, 1987 | [IE] | Ireland | 1353/87 |
| Jul. 17, 1987 | [IE] | Ireland | 1939/87 |

[51] Int. Cl.[4] ..... E05B 19/00

[52] U.S. Cl. ..... 70/395; 70/277; 70/411

[58] Field of Search ..... 70/411, 395, 277, 278, 70/276, 413

[56] References Cited

U.S. PATENT DOCUMENTS

| | | | |
|---|---|---|---|
| 3,403,380 | 9/1968 | Welch . | |
| 3,793,565 | 2/1974 | Smith . | |
| 3,955,388 | 5/1976 | Stackhouse | 70/411 |
| 4,177,657 | 12/1979 | Aydin . | |
| 4,411,144 | 10/1983 | Aydin . | |
| 4,534,194 | 8/1985 | Aydin . | |

FOREIGN PATENT DOCUMENTS

| | | | |
|---|---|---|---|
| 0256817 | 2/1988 | European Pat. Off. . | |
| 2022187 | 12/1979 | United Kingdom | 70/411 |

*Primary Examiner*—Robert L. Wolfe

*Attorney, Agent, or Firm*—Brumbaugh, Graves, Donohue & Raymond

[57] ABSTRACT

A key device which comprises a base (11) having seven substantially circular apertures (12,13,14,15, 16,17,18) therein. Each aperture (12–18) is adapted to receive a respective element (**12*a*–18*a*). The base (11) and the elements (12*a*–18*a*) are made from a non-electrically conductive material. Each of the elements (12*a*–18*a*) has seven predetermined locations on sites (21–27) adapted for the receipt of a metal pin. Thus the electrical characteristic of each site (21–27**) may be altered by the presence or absence of the metal pin. A key device can be assembled by a user having a particular combination of pins present. The combination of the pins present together with the orientation of the key device when presented to a detector means, which is adapted and programmed to determine the presence or absence of a pin at each site, may be used to actuate, for example, a lock.

24 Claims, 13 Drawing Sheets

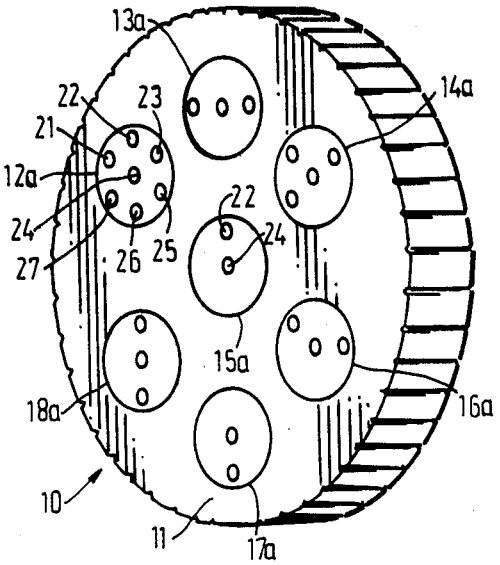
FIG.1
FIG.2
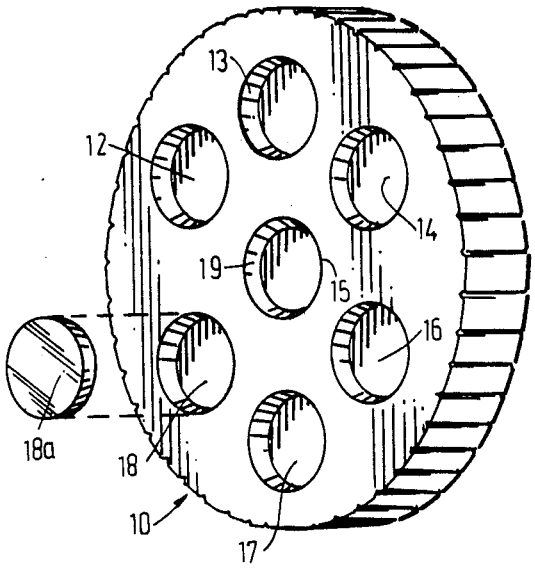

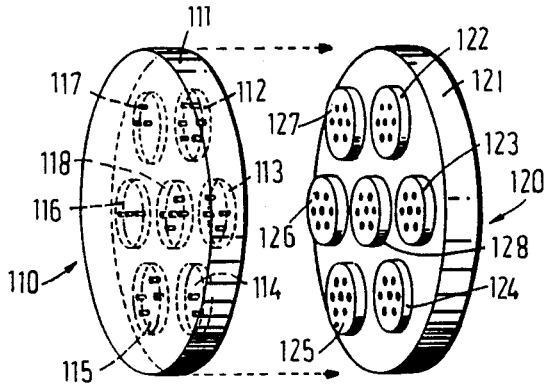
FIG.7
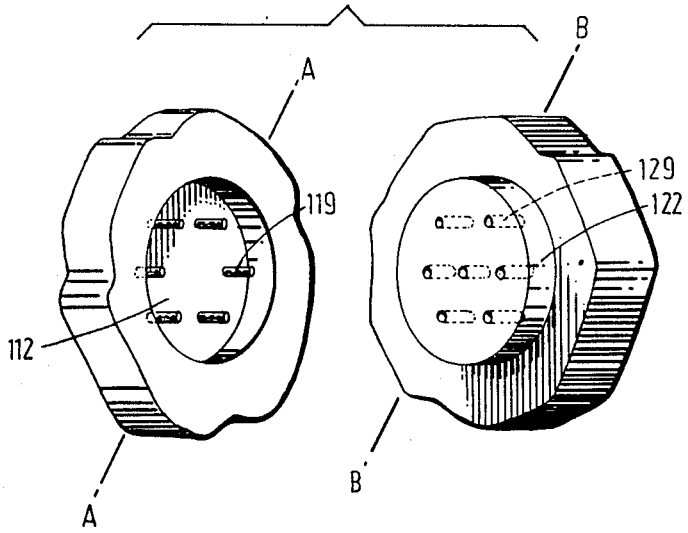
FIG.8
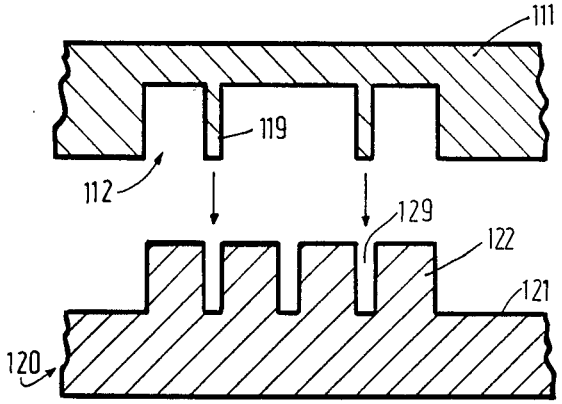
FIG.9a
FIG.9b

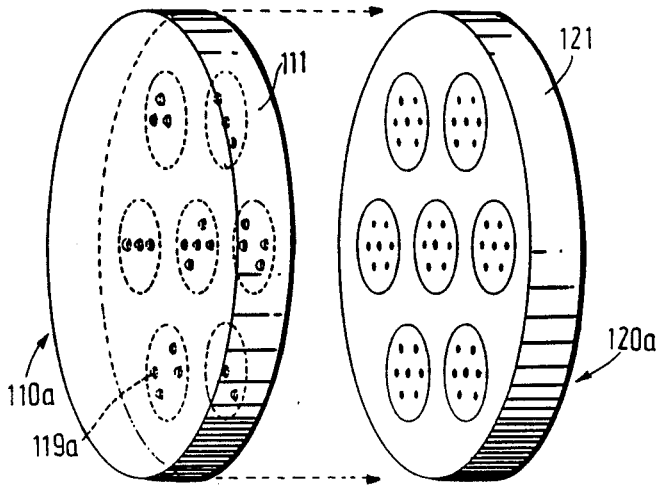
FIG.10
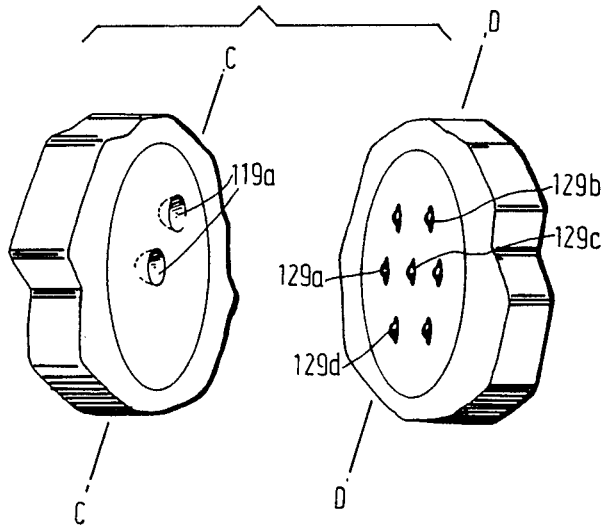
FIG.11
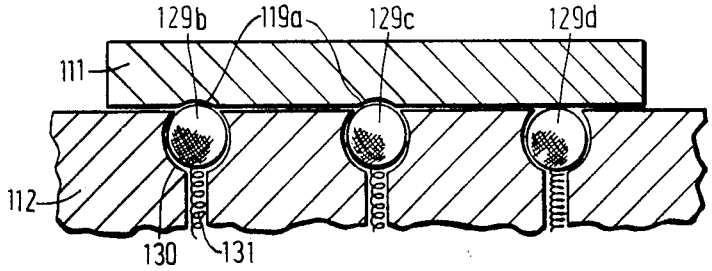
FIG.12a
FIG.12b

KEY DEVICE AND A DETECTOR DEVICE FOR USE THEREWITH

This invention relates to a key device and a detector device for use therewith.

Heretofore, a key generally comprises an instrument usually of metal for moving a bolt of a lock forwards or backwards to effect locking or unlocking. For reasons of security, the lock will have several elements therein which must be manipulated by a particular key to successfully operate it. The greater the number of elements, the more secure the lock will be as the number of differs available is relatively high and accordingly the chances of an unauthorised user accidentally having the correct key are remote.

A significant disadvantage of conventional lock and key arrangements is that the combination is not user changeable. To change the combination of a lock, it is usually necessary to bring the lock to a locksmith and then a key or keys must then be cut to suit the new combination.

It is known to actuate locks by other devices such as credit card type "keys" having a magnetic strip thereon. The strip is encoded so that when the card is inserted in a suitable receptacle, the "combination" on the strip is interrogated by, for example, a microprocessor and, if found to be correct, actuates the lock. Again, one disadvantage of such a system is that the encoding of the combination on the strip cannot be carried out relatively easily and cheaply by the user.

Another form of locking arrangement is the use of a key pad which the user operates with a predetermined code so as to actuate the lock. This system does have the advantage that the user can quickly and easily change the combination. However, the key pad and associated electronics are usually relatively expensive and, moreover, the key pad may have to be installed in a weather exposed environment.

It is an object of the present invention to overcome these problems by providing a key device which is relatively inexpensive to produce, may be assembled by a user and the same device may be used to actuate several "locks" having different combinations.

The invention therefore provides a key device which comprises a base having one or more sites associated therewith in a predetermined pattern; and wherein a measurable or detectable characteristic of the or each site may be selectively altered; the arrangement being such that the key device may be used in conjunction with a detector device having means for analysing the characteristic of the or each site.

The invention will be understood in greater detail from the following description of preferred embodiments thereof given by way of example only with reference to the accompanying drawings in which:

FIG. 1 is a perspective view of a first embodiment of a key device according to the invention;

FIG. 2 is an exploded view of the device of FIG. 1 of the drawings;

FIG. 7 is a perspective view of a second embodiment of a key device according to the invention and associated socket;

FIG. 8 is a detailed and enlarged view of part of the key device a socket of FIG. 7 of the drawings;

Figure 10:
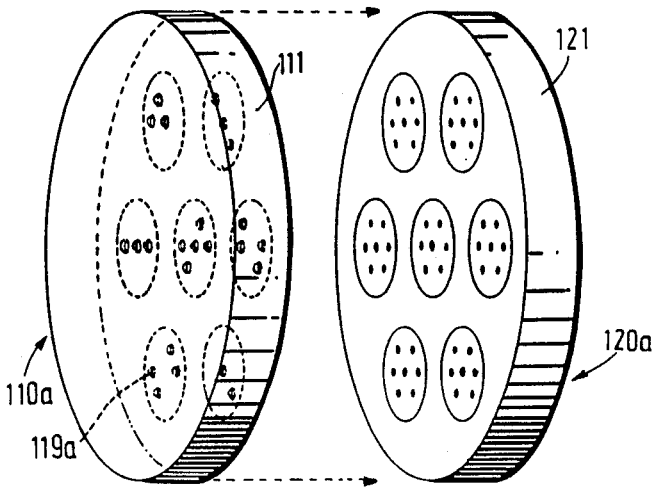
Figure 11:
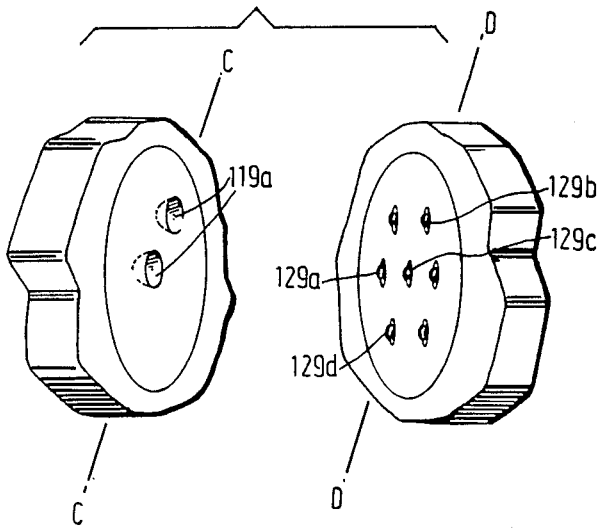
Figure 12A:
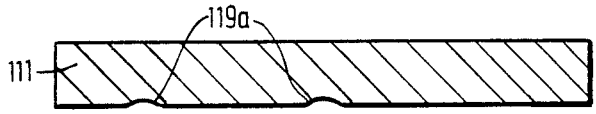
Figure 12B:
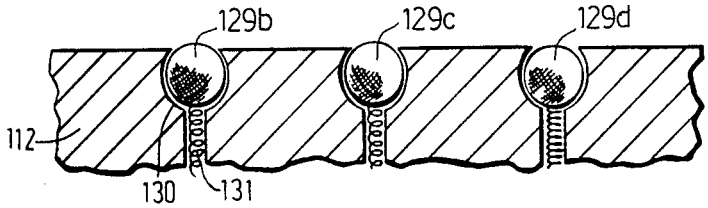
Figure 13:
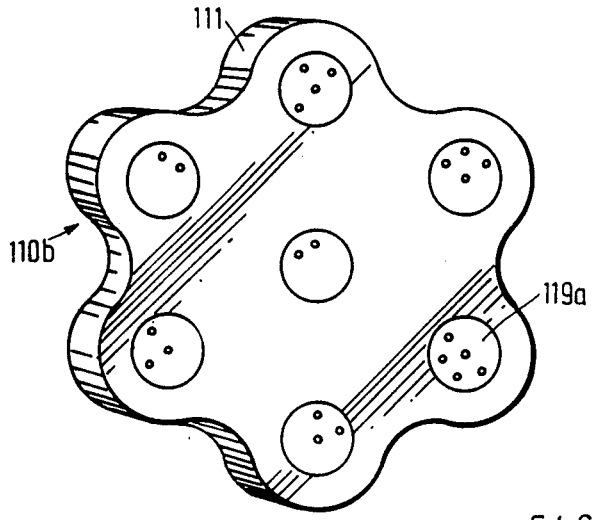
Figure 14:
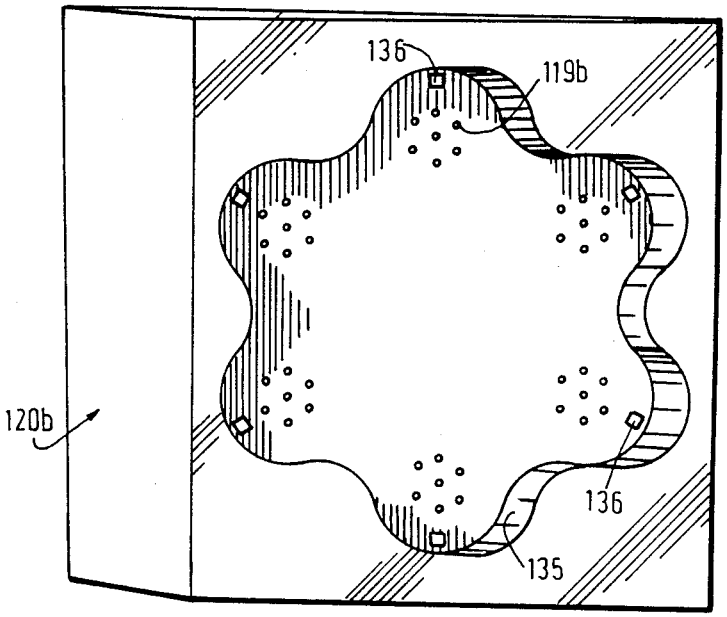
Figure 15:
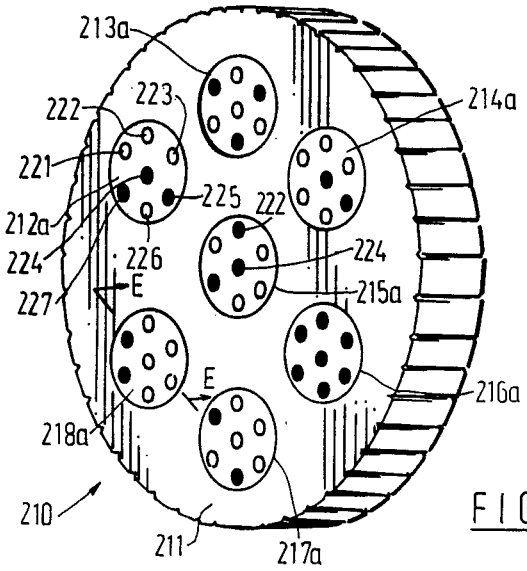
Figure 16:
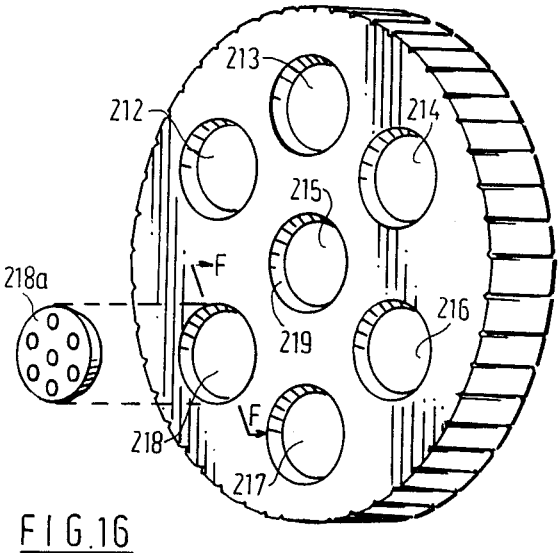
Figure 20:
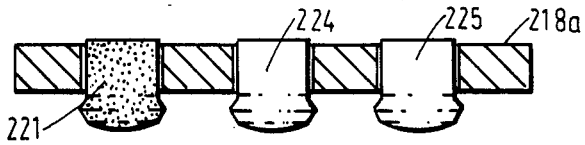
Figure 19:
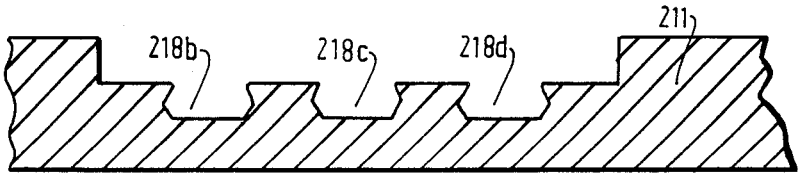
Figure 18:
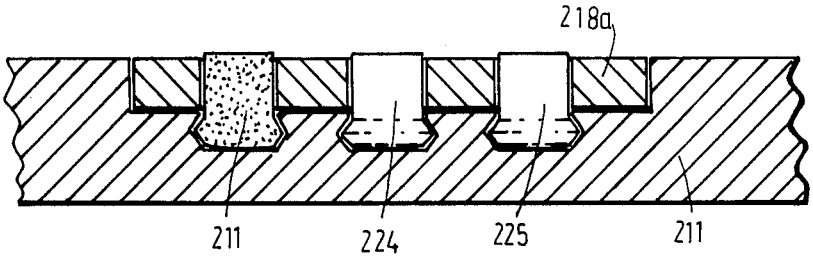
Figure 17:
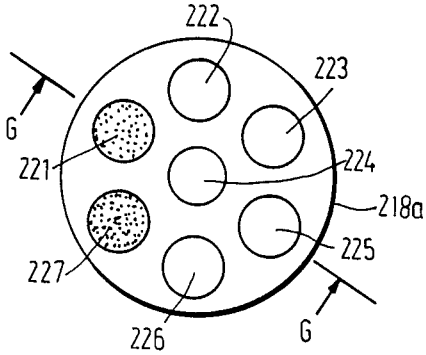
Figure 21:
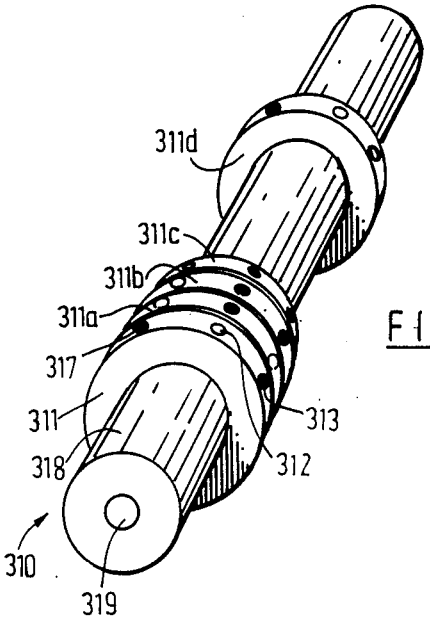
Figure 21A:
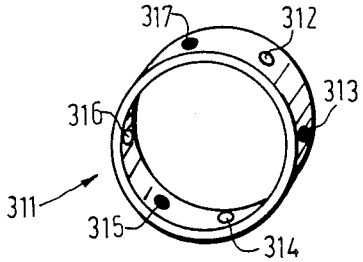
Figure 22:
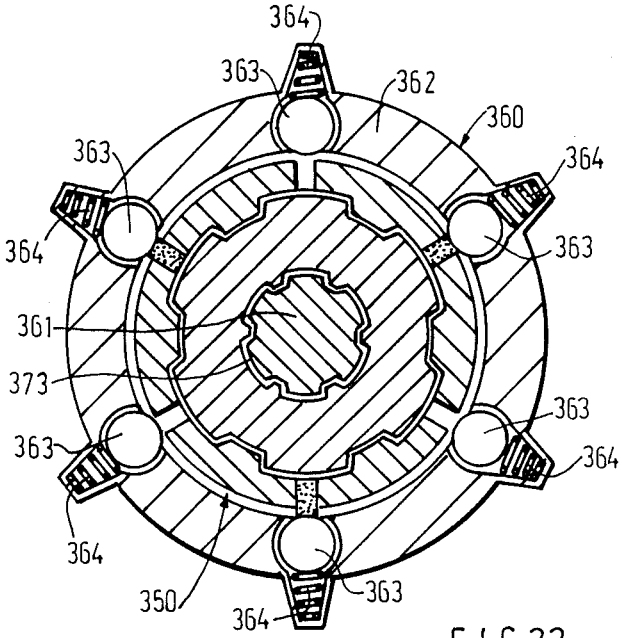
Figure 23A:
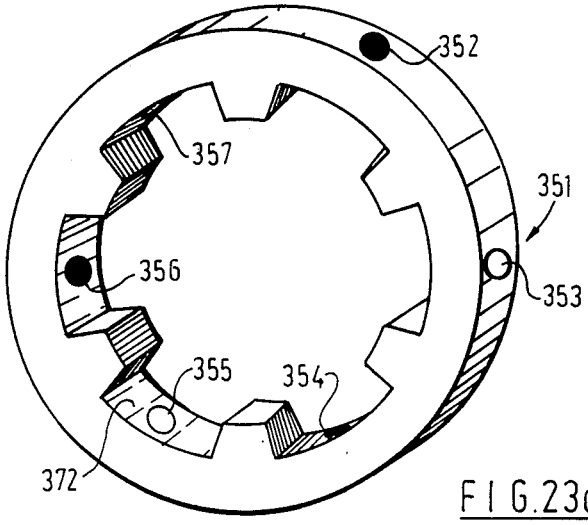
Figure 23B:
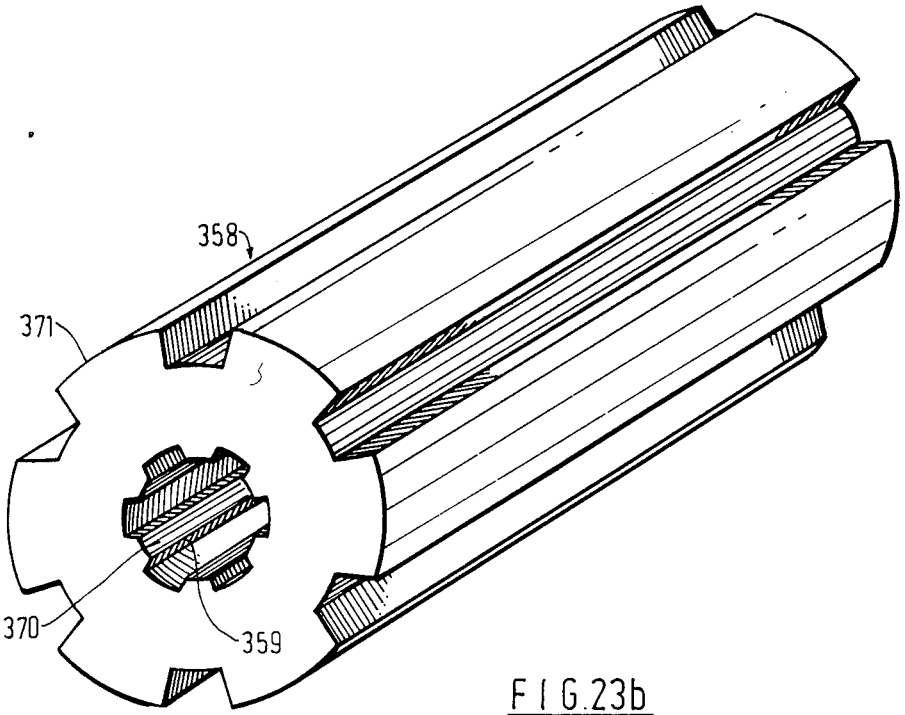
Figure 24A:
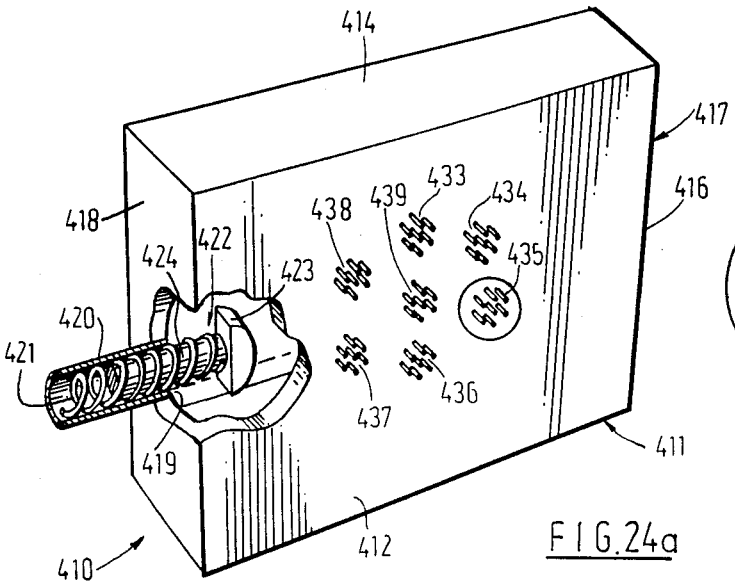
Figure 24B:
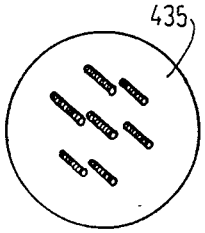
Figure 25:
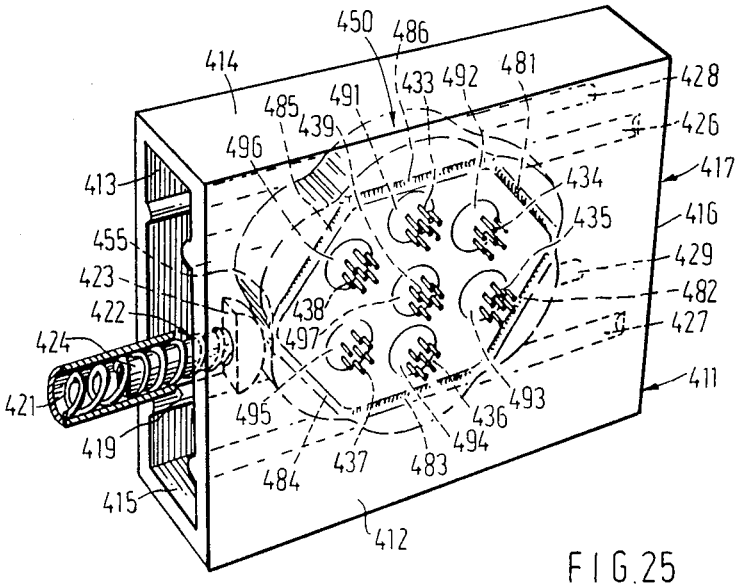
Figure 26:
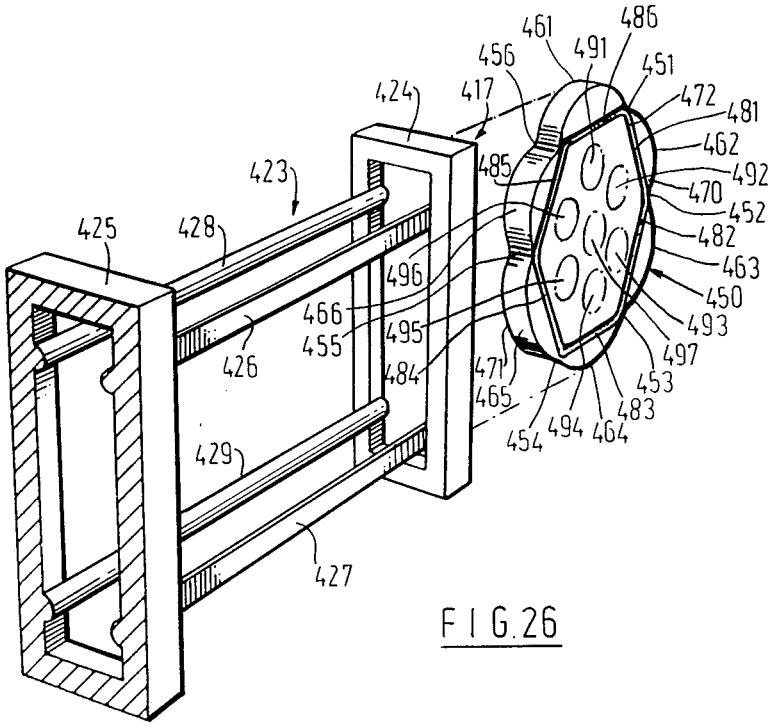
Figure 27:
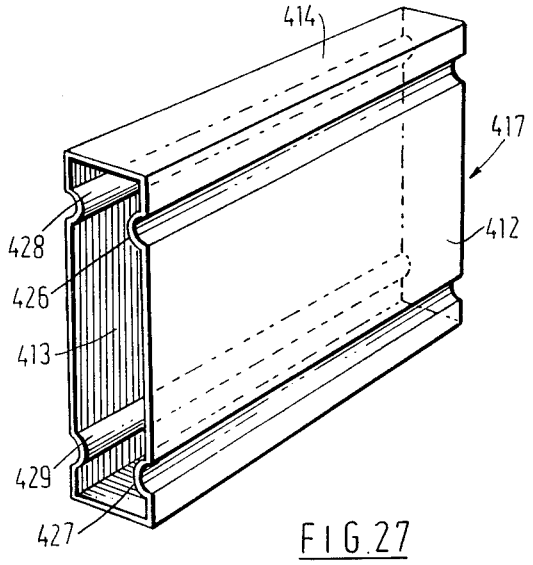

FIG. 9*a* an elevation of part of the key device of FIG. 7 of the drawings taken along the line A—A of FIG. 8 of the drawings;

FIG. 9*b* is an elevation of part of the socket of FIG. 7 of the drawings taken along the line B—B of FIG. 8 of the drawings;

FIG. 10 is a perspective view of a third embodiment of a key device according to the invention and associated socket;

FIG. 11 is a detailed and enlarged view of part of the key device and socket of FIG. 10 of the drawings:

FIG. 12*a* is an elevation of part of the key device of FIG. 7 of the drawings taken along the line C—C of FIG. 11 of the drawings;

FIG. 12*b* is an elevation of part of the socket of FIG. 7 of the drawings taken along the line D—D of FIG. 11 of the drawings;

FIG. 13 is a perspective view of a fourth embodiment of a key device according to the invention;

FIG. 14 is a perspective view of a detector means for use with the key device of FIG. 13 of the drawings;

FIG. 15 is a perspective view of a fifth embodiment of a key device according to the invention;

FIG. 16 is an exploded view of the device of FIG. 15 of the drawings;

FIG. 17 is a plan view of part of the device of FIG. 16 of the drawings;

FIG. 18 is a cross-sectional view of the device of FIG. 15 of the drawings taken along the line E—E and viewed in the direction of the associated arrows;

FIG. 19 is a cross-sectional view of the device of FIG. 16 of the drawings taken along the line F—F and viewed in the direction of the associated arrows; FIG. 20 is a cross-sectional view of part of the device of FIG. 15 of the drawings taken along the line G—G of FIG. 17 of the drawings and viewed in the direction of the associated arrows;

FIG. 21 is a perspective view of sixth embodiment of a key device according to the invention;

FIG. 21*a* is a perspective view of part of the device of FIG. 21 of the drawings;

FIG. 22 is a cross-sectional view of a seventh embodiment of a key device according to the invention and associated detector means;

FIG. 23*a* is a perspective view of part of the key device of FIG. 22 of the drawings;

FIG. 23*b* is a perspective view of another part of the key device of FIG. 22 of the drawings;

FIG. 24 is a perspective view, partly in section, of a detector according to the invention;

FIG. 25 is the detector means of FIG. 24 of the drawings with a key device according to the invention;

FIG. 26 is a perspective view of a first embodiment guide means for use with the detector means of FIG. 24 of the drawings; and FIG. 27 is a perspective view of a second embodiment of a guide means for use with the detector means of FIG. 24 of the drawings.

Referring now to the drawings and in particular to FIGS. 1–6 thereof, there is shown a first embodiment of a key device 10 according to the invention which comprises a substantially circular base 11 having seven substantially circular apertures 12, 13, 14, 15, 16, 17 and 18 therein. The diameter of each of the apertures 12–18 on the obverse side of the base 11 is slightly greater than the diameter of each of the apertures 12–18 on the reverse side of the base 11. Consequently, the wall of each of the apertures 12–18 tapers from the obverse side to the reverse side of the base 11 in the manner of a bevel. In addition, each wall has serrulations 19 thereon.

Each of the apertures 12–18 is adapted to receive a respective substantially circular element **12*a*–18*a*. Each of the elements 12*a*–18*a* tapers from the obverse side thereof in the direction of the reverse thereof. The side wall of each of the elements 12*a*–18*a* has serrulations 19*a*** thereon.

The base 11 and each of the elements **12*a*–18*a*** are made from a non-electrically conductive material such as a plastics material.

Each of the elements **12*a*–18*a* has seven predetermined locations or sites 21–27 thereon adapted for the receipt of a metal pin. Thus, for example, the element 12*a* has all seven sites 21–27 occupied by pins therein whereas the element 15*a* has only two sites occupied viz nos. 22 and 24**.

Essentially, a characteristic of each site may be altered by the presence or absence of a pin. In the present embodiment, the characteristic is electrical.

Each element **12*a*–18*a* is rotatable relative to its respective aperture. Accordingly, an element (say) 15*a* with sites 22 and 24 occupied by respective pins could be used as element 17*a* by rotating it through 180 degrees. In the present example, the seven sites 21–27 can be represented in any one of 128 configurations. However, having regard to the fact that each element 12*a*–18*a* can be rotated relative to its respective aperture 12–18, the actual number of elements 12*a*–18*a* required to avail of the full variability of the device 10** is twenty-eight hereinafter referred to as a set of elements.

If desired, each aperture 12–18 may have one or more datum marks associated therewith. For example, the aperture 18 has datum marks A, B, C, D, E and F associated therewith. Similarly, each element **12*a*–18*a* may have one or more datum marks associated therewith. Thus, the element 18*a* having three sites occupied may be inserted so that the datum marks A, B, C, D, E and F of the element 18*a* are in register with the marks A, B, C, D, E and F respectively of the aperture 18. Accordingly, the element 18*a* will have sites 23, 24 and 26 effectively occupied by pins. If, however, the element 18*a* is rotated relative to the base 11 so that the datum marks A, B, C, D, E and F of the element 18 are in register with the datum marks C, D, E, F, A and B respectively of the aperture 18, the element 18*a* will have the sites 21, 24 and 25 effectively occupied. It will be appreciated, therefore, that the single element 18*a* having three pins therein may function as an element having the sites 21, 24 and 25** effectively occupied as well as the sites referred to above occupied.

The base 11 is of the order of about 2 mm thick and otherwise has the dimensions of a large coin or moderately sized medallion.

In use, a user will be supplied with the base 11 and, in order to provide the maximum degree of security possible, seven sets of elements. As there are seven elements per base; seven sites per element; and six discrete orientations of each element relative to its respective aperture of the base, the number of possible combinations is nearly 100 billion billion. The user then selects seven elements of choice and inserts them into the apertures of the base. The elements may be inserted into the apertures in a predetermined orientation or randomly as desired. Care should be taken to ensure that the datum marks on each of the elements are in register with respective datum marks on the base associated with the aperture. The user will now have constructed a key having a particular combination.

Rather than requiring the user to purchase seven sets of twenty-eight elements, the user could purchase a base and select at the retail outlet seven or more elements of choice. It will be appreciated, of course, that only a minimum number of seven need by purchased to enable the key device 10 to be constructed.

By virtue of the conical shape of each of the elements **12*a*–18*a* and further having regard to the serrulations 19 of each of the apertures 12–18 and the serrulations 19*a* of each of the elements 12*a*–18*a*, each of the elements 12*a*–18*a* is retained in its respective aperture 12–18 as a tight fit. However, any one of the elements 12*a*–18*a* may be removed from its respective aperture 12–18 by pushing from the reverse side of the base 11 and reinserted in a different orientation so as to construct a key device 10** having a different combination.

The key device 10 may be used with a suitable detector device 30 capable of ascertaining the presence or absence of a pin from a site. Essentially, therefore, the detector device 30 is capable of ascertaining the characteristic of each site. Briefly, the detector device 30 shown in FIG. 5 of the drawings essentially comprises a housing 31 having a slot 32 for the reception of the key device 10.

Operatively associated with the slot 32 are seven clusters 33, 34, 35, 36, 37, 38 and 39 of electrically conductive probes. The clusters 33–39 are arranged in a pattern similar to the pattern of the apertures on the base 11.

Each of the clusters 32–39 comprises fourteen electrically conductive probes arranged in seven sets of two probes each. Each of the sets of probes is arranged in the pattern similar to the arrangement of sites of the elements **12*a*–18*a***.

Thus, when the device 10 is inserted into the slot 32, each of the clusters 32–39 will be in register with a respective element **12*a*–18*a*. Furthermore, each set of probes of each cluster 32–39** will be in register with a notional or actual site as the case may be.

To ensure than when the device 10 is inserted into the slot 32, the clusters 32–39 are in register with respective elements **12*a*–18*a*, the base 11 is provided with an interengaging surface such as a groove or projection (not shown) adapted for engaging with any one of six complementary interengaging surfaces (not shown) in the slot 32**.

Figure 3:
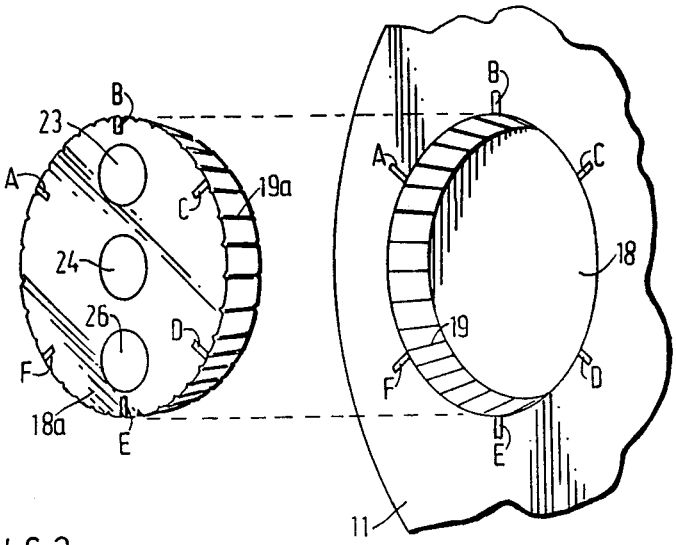
FIG. 3 is a first enlarged view of part of the device of FIG. 2 of the drawings.
Figure 4:
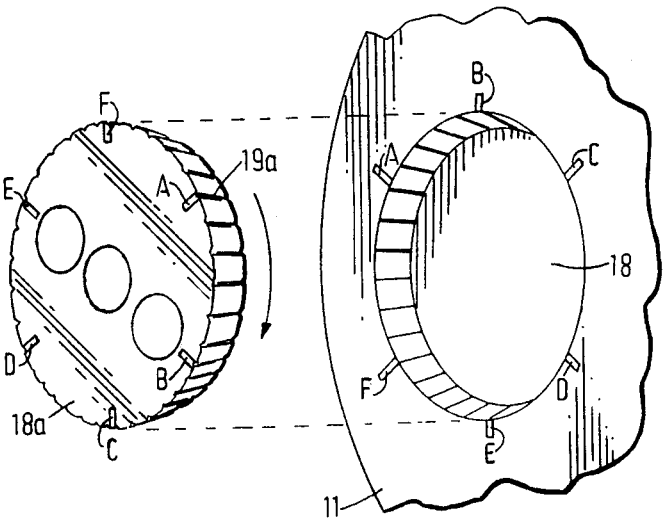
FIG. 4 is a second enlarged view of part of the device of FIG. 2 of the drawings.
Figure 5:
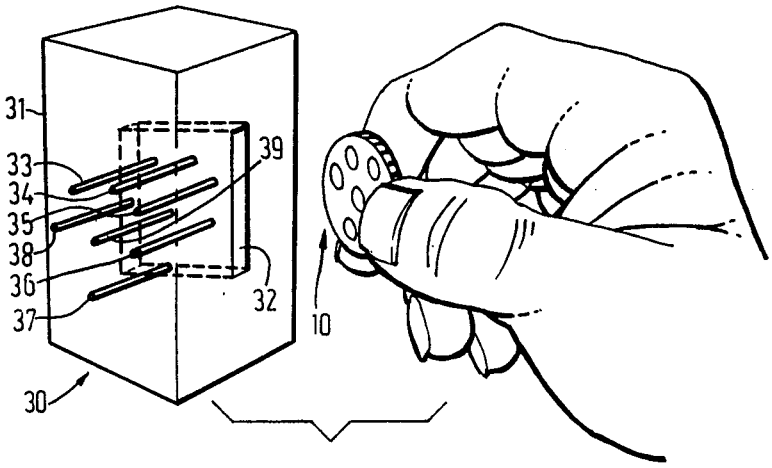
FIG. 5 is a cut away view of a receptacle for use with the device of FIG. 1 of the drawings.
Figure 6:
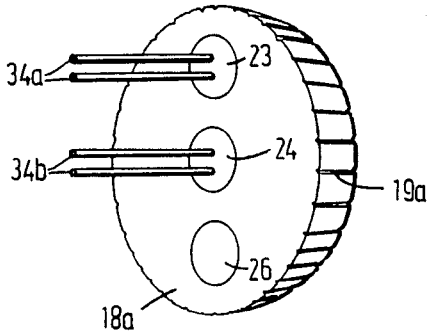
FIG. 6 is an enlarged view of part of the device of FIG. 1 of the drawings shown in use.

With reference to FIG. 6 of the drawings, there is shown the element **18*a* with three sites occupied by metal pins viz 22, 24 and 26. Contacting the surface of the pin at the site 23 is a pair of probes 34*a* from the cluster 34. Contacting the surface of the pin at the site 24 is a pair of probes 34*b* from the cluster 34. For reasons of clarity, only two sets of probes 34*a*, 34*b* are shown but it will be appreciated that each of the remaining sets of probes of the cluster 34** would be in contact with a respective notional site or actual site.

Accordingly, therefore, if an electric current is present in one of the probes of a set and a site is occupied by a metal pin, current will flow through to the other probe of the same set. By connecting the probes to a suitable microprocessor (not shown) and related electronics (details of which are not given here but which will be familiar to those skilled in the art), it is possible, by appropriate programming of the microprocessor, to enable it to "recognise" a particular "combination" of pins present in the device 10 and if found to be a valid combination, actuate a lock or other device as appropriate.

When the user has created a combination as described above, the device 10 is inserted into the detector 30 and the microprocessor is actuated so as to "learn" the particular combination present on the device 10. When inserting the device 10 into the detector 30, the orientation of the groove or projection relative to the slot 32 should be noted. Subsequently, when the device 10 is inserted into the detector 30 in the same orientation, as the device 10 has the combination recognisable by the microprocessor, the latter will actuate, say, a lock operatively associated therewith.

It will be appreciated that the device 10 having a particular set of elements thereon may be used to actuate another detector device by way of a different combination. For example, if the device 10 is inserted into the slot 32 so that the groove or projection thereof is orientated, say, 60 degrees when compared with the above described orientation, a different combination will now be presented to the detector 30.

Accordingly, if the device 10 now referred to is inserted into another detector 30 in the new orientation so as to programme the microprocessor with the present combination, the same device 10 will be capable of actuating both detectors. Thus, a single device 10 may be used to actuate up to six differently programmed detectors without the need to alter the positions of the elements **12*a*–18*a* relative to the base 11**.

It will be appreciated, therefore, that a user, having constructed a key device 10 as described above, can use the same key device 10 without any alteration for actuating up to six differently programmed detectors. It will be appreciated further that if any one element **12*a*–18*a* of the thus constructed key device 10 is rotated relative to the base by say 60 degrees, the key device 10 may now be used to actuate another six differently programmed detectors. Thus, the user need not carry a bunch of conventional keys each of which opens a respective lock; the user need only carry one key device 10** according to the invention.

Furthermore, if the device 10 is lost or stolen and provided that the authorised user has rotated at least one of the elements **12*a*–18*a* relative to the base 11** to provide a combination not relevant to his property an unauthorised user will have considerable difficulty in determining the correct combination having regard to the relatively large number of differs available therefor.

As a further security measure, the micro-processor could be programmed such that if a device 10 is inserted into the detector 30 which device 10 does not have the correct combination vis-a-vis the detector 30, only two further attempts by the user to insert the device 10 having the correct combination and in the correct orientation would be allowed whereupon no further attempts, either authorised or unauthorised, would be processed by the microprocessor for a period of time such as fifteen or thirty minutes. This would prevent an unauthorised user trying to determine by trial and error an unknown correct combination and/or orientation.

In the present example, metal pins are used to enable electric current to flow in the relevant probes associated therewith. However, the characteristic of each site may be altered by means of any detectable electrical quantity e.g. resistance, capacitance, inductance, frequency or impedence can be exploited if the relevant sites are appropriately provided with suitable means for such use. It will be appreciated that the metal pins could be replaced by magnets, holes or mirrors or some other means which would positively interact with suitable detector means 30 and associated microprocessor. If magnets are employed, the detector probes could have a magnetic field induced therein which would be detectable by the microprocessor. If holes or mirrors are employed, the clusters of probes could be replaced by fibre optics and light or infra-red radiation could be used in place of electric currents or magnetic fields. In that event, the microprocessor would be adapted to register the presence or absence of light at the relevant sites as the case may be.

The sites may be used as input and output terminals for electrical signaling. For example, a single site might have input and output terminals at respective faces of the element or some sites could be used as input terminals and other sites as output terminals.

Furthermore, the shape and configuration of the base 11 and or the elements **12*a*–18*a*** need not necessarily be circular and could be any other desired shape.

The device 10 according to the invention is easier to use than either a conventional key or a conventional combination lock since no manipulation other than insertion of the device 10 into the detector 30 is required.

The device 10 offers greater reliability than conventional key operated mechanical locks because solid state electronic devices are inherently more reliable than analogous mechanical systems. The detector is mechanically less complex and has fewer moving parts than a mechanical lock; further the receptacle can be stereotyped; whereas every key operated conventional lock must be mechanically unique. Thus there are considerable savings in production costs.

A mechanical lock has to be completely replaced when faulty whereas in the detector, only the electronics, which can be in the form of a card, cartridge or module, need be replaced.

The detector can be easily sealed against tampering by mechanical probes, acoustic implements, drills or even explosives, since the detector can be remote from the associated lock.

As the key device 10 need not be manipulated when in use, the space required for such manipulation is not necessary. Advantage can be taken of this to provide added security by placing the slot of the detector in a hidden or relatively inaccessible place.

With certain types of handicap, turning a conventional key may not be possible. The key device 10 does not require turning when in use—merely insertion.

Furthermore, the key device 10 need not require even insertion but could be operated by simply presenting or placing the key device 10 on a detector pad in the correct orientation relative thereto.

The usual method of cutting a "spare" conventional key requires the appropriate blank, the necessary machine and a copy of the key to be cut. Any of these may be unavailable. However, the user can construct a key device 10 at any time or place using a base and appropriate elements inserted therein. The configuration can be stored in a diary or any other convenient secure place.

Further, if a conventional key is lost the only remedy is to replace the lock which is destructive, time consuming and expensive. This inconvenience is obviated by the key device 10. In this way, the key device 10 can obviate the problem of departing on a journey having forgotten the "key" to the destination.

It is common for persons to lock conventional keys in, e.g. into a car. Again the key device 10 eliminates this problem.

Where an unauthorised person removes a key 10 from e.g. a hotel a new device 10 key can be assembled and the detector reprogrammed.

The key device 10 and detector have advantages over combination type locks insofar as they are mechanically less complex and no key pad or key panel is required. In any event there are situations where the use of a panel or keypad would be impractical e.g. on the outside of a car door. Furthermore, the time and effort required to key in a combination are greater than required to operate the key device 10. Sometimes the memorization of a combination is not practible, e.g. an elderly person or a young child. The key device 10 and its component parts admit of a naming convention, either private or public, so the configuration can be transmitted as data in the manner of an ordinary combination, e.g. by way of the telephone.

The key device 10 can hold several configurations whereas it would be very difficult if not impossible to remember the equivalent in separate combinations.

If an easy configuration is required a mnemonic design can be used when constructing the combination. The key device 10 can be used without any onlooker seeing the design.

Apart from any specific advantages over existing locks, the fact that the key device 10 supplies data indicates that the key device 10 and the detector can avail of any advantage that can accrue from processing the data. Any shortcomings the key device 10 and detector might have as a lock can be compensated for by the associated circuitry and there is scope for such features as computerised central locking etc. Alarms and other facilites can be added and programmed to operated under a range of circumstances. Additional security features can be obtained using timing and similar circuits in conjunction with the detector, which would not be possible with conventional locks. Since the detector depends on electronic rather than mechanical technology, and since micro-circuitry is now so relatively inexpensive, it is possible to provide added reliability by supplying the detector with two or more copies of the working circuitry. In the event of failure on one circuit, the other would operate. The electronics part of the detector could be disposable and be supplied in modular form in duplicate or triplicate.

One key device 10 can be used to operate many locks and many key devices 10 may be used to operate a single lock, features which are useful in any situation where a "master key" is required. The same key device 10 could be used to operate locks that work on diffrent physical principles e.g. steel elements in the key device 10 could be detected in receptacles either as conductors of electricity or ferro-magnetic elements.

The effective sites on the elements of the key device 10 could be represented by raised dots or projections to facilitate use by non-sighted users in the manner of the Braille system of printing.

The key device 10 could be disposable. Thus, less durable versions, e.g. on card, could be used in place of tickets etc.

Although the key device 10 need not be manipulated when in use, it could be manipulated if desired to provide extra security. For example, the base could be used as an element in a larger device or multi-tiered device.

The combination can be used to carry information other than in the nature of security coding, for example, the identity of the user.

The key device 10 could be used to operate gaming machines , phones, clocking in and out operations, cash registers and the like. It could also form the main element in leisure games such as games of chance etc.

With the appropriate back-up installation the key device could replace most ticket-controlled operations at, for example, concerts and the like.

By placing a detector on the keyboard of a computer the utility of the keyboard itself could be vastly enhanced by the use of the key device 10, for programme control and initiation. Similarly, multiple robotics control can be ergonomically simplified, especially for the disabled, by the use of one or more of the devices 10.

By placing input and output terminals in the sites and furnishing the base with some data processing circuitry the key device 10 can be used as a very powerful instrument. It could be an interface between almost any electronic systems.

Wherever the word "lock" is used above or anywhere in this specification, it applies to any means of securing any system whether the system be a data system or a physical system regardless of the purpose for which it is secured, whether by reason of safety, secrecy, enclosement, fastening or other reason.

Referring in particular to FIGS. **7–9*b* of the drawings, there is shown a second embodiment of a key device 110 according to the invention which comprises a disc shaped element 111 having seven circular apertures 112,113,114,115, 116,117 and 118 therein. In each aperture is mounted seven pins 119. Each pin 119 is of a type which may be broken from the aperture base. Accordingly, a user having purchased the disc shaped element 111 (having a total of forty-nine pins arranged in seven groups of seven), can construct the required pin arrangement and configuration by breaking the pins 119 which are not required and removing them from the aperture base. Accordingly, the user can construct a desired pattern and number of pins. The presence or absence of a pin 119** at a respective site determines the characteristic of the site.

For example, in FIG. 8 of the drawings there is shown an enlarged view of one of the apertures 112 having six pins 119 therein arranged in a predetermined pattern.

Also shown in FIGS. **7–9*b* of the drawings is a detector device 120. The detector device 120 comprises a disc shaped element 121 having seven circular projections 122,123,124,125,126,127 and 128 therein. In each projection 122–128 is seven sockets 129. Each of the sockets 129 is connected by a suitable cable (not shown) to a micro-processor means (not shown). The pattern and number of the pins 119 in the apertures 112–118 determines the "combination" of the key device 110**.

In use, when the key device 110 is plugged into the detector device 120, each of the pins 119 engages with a respective socket 129 of the detector device 120. The absence or presence of a pin 119 relative to a particular socket 129 is monitored by the micro-processor means. The first occasion the key device 110 is plugged into the detector device 120, the micro-processor is placed in a "learning" mode so as to determine the number and pattern of pins 119 presented to the detector device 120. The number and pattern is programmed into the microprocessor memory. Accordingly, if that key device 110 is plugged into the detector device 120 on subsequent occasions, the micro-processor compares the number and pattern of the pins with the preprogrammed pattern and number. If the pattern and number of the pins 119 is found to be the same as the predetermined pattern and number, the micro-processor means outputs a signal which may be used to, for example, unlock a door. If the pattern and number of pins 19 is not recognised by the micro-processor means, no signal is outputted therefrom and the lock, for example, remains locked.

It will be appreciated the key device 110 if rotated so that the aperture 112 is in register with the projection 123 (rather than the projection 122 as shown in the drawings), a different pattern of pins 119 will be presented to the sockets 129 of the detector device 120. Accordingly, the same device 110 could be used for successful operation with up to six differently programmed micro-processor means associated with respective detector devices.

With reference to FIGS. 10–12*b* of the drawings, a third embodiment of a key device 110*a* and a detector device 120*a* is shown. The key device 110*a* and the detector device 120*a* are essentially similar to the key device 110 and the detector device 120 except as follows.

Instead of providing a plurality of pins 119, there is provided a plurality of sockets 119*a* in the key device 110*a* arranged in a user predetermined pattern and number. The presence or absence of a socket 119*a* at a respective site determines the characteristic of the site. The detector device 120*a* instead of having a plurality of sockets comprises a plurality of balls 129*a* of the ball bearing type retained in the device 120*a* by suitable respective ball housings 130. Each ball 129*a* is biased outwardly by a respective spring 131. The position of each ball 129*a* may be monitored by the micro-processor means.

When the key device 110*a* is in register and abutting relationship with the detector device 120*a*, those balls 129*a* which are in register with the socket 119*a* will remain biased outwardly by its respective spring 131; those balls 129*a* which are not in register with a respective socket 119*a* will be pushed downwardly by the key device 110*a*. So for example in FIG. 12*a* and 12*b* of the drawings, it will be seen that the balls 129*b* and 129*c* are not pushed downwardly by the key device 110*a*having regard to the presence of the two sockets 119*a*, 119*a* of the key device 110*a*. However, the ball 129*d* is pushed downwardly due to the absence of a socket 119*a* at the relevant location of the key device 110*a*.

The pattern of depressed or non-depressed balls 119*a* is monitored by the micro-processor means and, if the pattern and number of balls depressed, for example, coincides with a preprogrammed instruction to the micro-processor, then the micro-processor outputs a signal to open, for example, a lock.

Although not shown in the drawings, the sockets 119*a* may be absent. Instead, the key device 110*a* is made from an electrically conducting material. A circular sheet of paper (not shown) may be placed over one face of the device 110*a*. The sheet of paper will have a pattern of holes therein the number and location of the holes corresponding to the number and pattern of sockets 119*a*. Accordingly, when the key device 110*a*is in register and abutting relationship with the detector device 120*a*, those balls 129*a* which are in register with a hole in the paper will be in direct contact with the base of the key device 110*a* thereby bridging an electrical circuit which may be detected by the micro-processor. Those balls 129*a* which do not encounter holes in the paper will be insulated from the base of the key device 110*a* and the absence of a completed electrical circuit may be detected by the micro-processor.

Again, as before, the orientation of the key device 110*a* will present different patterns to the detector device 120*a* and accordingly may be used in a manner described above.

With particular reference to FIGS. 13 and 14 of the drawings, a fourth embodiment of a key device 110*b* is shown which is similar in construction to the key device 110*a* of FIGS. 10–12*b* of the drawings except that it is shaped as shown rather than being circular in plan. In addition, the element 111 is electrically conductive.

A detector device 120*b* is essentially similar to the detector device 120*a* of FIGS. 10–12*b* of the drawings except that the clusters of balls 119*b* are located in a recess 135 having the same shape and configuration as the key device 110*b*.

Located in the vicinity of each cluster of balls 119*b* is a respective contact verifier probe 136. One of these probes 136 serves as a reference voltage probe for all of the other probes 136. The other five probes 136 permit a reading of the key device 110*b* to be taken only when the metal element 111 of the key device 110*b* is in contact with all six of the verifier probes 136.

To use the key device 110*b* in conjunction with the detector device 120*b*, the key device 110*b* is pressed against the detector device 120*b* to permit the reading of the presence or absence of sockets 119*a* as previously described. The key device 110*b* may be orientated relative to the detector device 120*b* as desired. The shape and configuration of the key device 110*b* and the detector device 120*b* can be as desired.

Referring now to FIGS. 15–20 of the drawings, there is shown a fifth embodiment of a key device 210 according to the invention which comprises a substantially circular base 211 having seven substantially circular apertures 212, 213, 214, 215, 216, 217, and 218 therein. Each of the apertures 212–218 is adapted to receive a respective substantially circular element 212*a*–218*a*. The base 211 is made from a non-electrically conductive material such as a plastics material.

With particular reference to FIG. 19 of the drawings, each of the apertures 212–218 has a shape or configuration associated therewith. In essence, each aperture 212–218 has seven smaller apertures, three of which 218*b*, 218*c* and 218*d* are shown at FIG. 19 of the drawings. The smaller apertures 218*b*, 218*c*, 218*d* essentially function as sockets and have a shape or configuration as shown in the drawings.

One of the elements 218*a* is shown in FIG. 17 of the drawings. The element 218 is circular in plan having seven pins 221–227 projecting from one side thereof. The pins 221–227 are intergral with the element 218*a*. The pins 221 and 227 are made from material which is electrically conductive; the remaining pins 222–226 are non-conductive. Thus, the characteristic of each site is determined by the presence or absence of an electrically conductive pin or the presence or absence of a non-electrically conductive pin.

Each of the pins 221–227 has a shape or configuration enabling it to be inserted into the respective small apertures in the manner of a plug and socket arrangement. Thus, the pins 221, 224, and 225 are insertable into the smaller apertures 218*b*, 218*c* and 218*d* respectively.

It will be appreciated that the element 218*a* could be rotated so as to present, for example, the pins 222, 224, and 226 of the smaller apertures 218*b*, 218*c* and 218*d* respectively.

It will also be appreciated that the element 218 having the particular combination of electrically conductive and non-conductive pins is but one example of thousands of such combinations ranging from seven electrically conductive pins to seven non-electrically conductive pins.

The other elements 212*a*–217*a* are similar in construction to the element 218*a* being representative of the variations of the possible combinations referred to above.

The manufacturer of the key device 210 would make the base 211 and each permutation of pins of which the element 218*a* is an example.

A user would purchase the base 211 and at the point of sale would select seven such elements at random. The user would then place each of the elements in a respective aperture 212–218 as desired. The user can also decide the orientation of each of such elements relative to the base 211 as desired.

The user has now constructed a key device 210 having a particular combination which may be used in conjunction with a detector means 30 described above or the detector means described below.

Referring now to FIGS. 21 and 21*a* of the drawings, there is shown a sixth embodiment of a key device 310 according to the invention.

In the previously described embodiments of the key device according to the invention, the key devices have essentially been of two-dimesional structure. In the present embodiment, the key device 310 is essentially of three-dimensional construction.

The key device 310 comprises a base or hub 318 and a plurality of elements 311–311*d*. The element 311 is ring-shaped having six predetermined locations or sites 312–317 thereon. The characteristic of each site 312–317 may be altered when occupied by a pin, ball, hole, projection, electrically conductive material, non-electrically conductive material, magnetic material, non-magnetic material etc so as to distinguish the site from the element 311. The characteristic may be similar that already described above with reference to FIGS. 1–20 of the drawings.

For example, the element 311 has sites 313,315,316 and 317 occupied by balls of a type similar to that disclosed with respect to FIGS. 10–12*b* of the drawings.

On to the hub 318 is mounted or threaded the elements of 311*a*, 311*b*, 311*c* and 311*d* including the element 311. The elements 311*a*–311*d* are similar in construction to the element 311 but have a different configuration of sites 312–317 occupied by balls. The element 311*d* is shown being pushed into position adjacent to the element 311*c*.

It will be appreciated that stop members (not shown) would be provided on the hub 318. However, each of the elements 311–311*d* would be rotatable on the hub 318 to enable a different combination of sites to be orientated relative to each other and to a suitable detector means (not shown).

The hub 318 has a through bore 319 for enabling the key device 310 to engage with the suitable detector means so that a read head of the detector means embraces the elements 311–311*d*. The read head has the capacity to detect the characteristic of each site 312–317 of each element 311–311*d*. The manner of detecting the characterist of each site 312–317 may be determined in a manner similar to that described with reference to FIGS. 22–23*b* of the drawings.

In FIGS. 22–23*b* of the drawings, there is shown a seventh embodiment of a key device 350 according to the invention. The key device 350 is essentially similar to the key device 310 described above. The key device 350 comprises a base or hub 358 having a plurality of elements thereon of which one, 351 is shown. The element 351 has six potential sites 352,353,354,355,356 and 357. The sites 352, 354 and 356 are occupied by electrically conductive material; the element 351 being electrically non-conductive. The remaining sites 353, 355 and 357 are occupied by electrically non-conducting material.

The hub 358 is made of an electrically conductive material. The hub 358 has a through bore 359. Both the bore 359 and the outer peripheral wall of the hub 358 have respective splines 370, 371 thereon. The inner wall of the element 351 also has splines 372 adapted for interengaging with the splines 371 of the outer peripheral wall of the hub 358.

As in the case of the key device 310, the key device 350 is constructed by sliding a plurality of elements 351 having different configurations of occupied sites thereon on to the hub 358. It will be appreciated that the greater the number of elements 351 present on the hub 358 the more complex the combination of the key device 350.

The key device 350 may be used with a detector means having a read head 360. The read head 360 essentially comprises a shaft 361 having a splines 373 adapted for interengaging with the splines 370 of the bore 359 and a read head member 362 for each key device 350 present on the hub 358. Each read head member 362 comprises six circumferentially arranged electrical conductive ball bearings 363 biased by a respective spring 364. The ball bearings 363 are arranged so that, having regard to the interengaging of the splines 370 with the splines 373 of the shaft 361, each ball bearing 361 is in register with a respective site 352–357. The shaft 351 is electrically conductive and accordingly, as the sites 352, 354 and 356 are occupied by electrically conductive material, an electrical circuit is completed between the ball bearings 363 associated with the sites 352, 354 and 356. There would be no electrical circuit completed with respect to the ball bearings 363 associated with the non-occupied sites 353, 355 and 357. This configuration of occupied/unoccupied sites is detected by a mirco-processor and analysed. The different configurations of the other similar elements 351 on the hub 358 are also analysed and if the combination thus detected is the same as the pre-programmed combination, a lock may be actuated by the mirco-processor.

If desired, only one read head member 362 may be present. In that event, to detect the configurations of each element 351, the mirco-processor would be adapted to determine each configuration as each element 351 passed through the read head member 362.

The advantages of the key devices 110, 110*a*, 110*b*, 210, 310 and 350 together with the variation with respect to the manner of providing occupied sites are similar to those previously described with respect to the key device 10. Furthermore, the shape and or configuration of the key devices according to the invention need not necessarily be confined to that shown in the drawings but could be square, triangular etc.

Referring now to FIGS. 24–27 the drawings, there is shown a detector means 410 according to the invention which comprises a housing 411 of substantially rectangular shape having side walls 412,413; a top 414; and a base 415. One end 416 of the housing has an opening or slot 417; the other end 418 of the housing 411 has an opening or circular hole 419. The circular hole 419 is in communication with a tube 420 having a spring 421 therein. A plunger 422 having a head 423 and a rod 424 is mounted so that the head 423 is inside the housing 411 and the rod 424 passes through the hole 419 and into the tube 420. The spring 421 is adapted so as to bias the plunger 422 into the housing 411. Operatively associated with the plunger 422 is a switch means (not shown) which is responsive to the reciprocal movement of the plunger 422.

The housing 411 may have an internal structure of a type shown in FIG. 26 of the drawings or alternatively of a structure of the type shown in FIG. 27 of the drawings.

With particular reference to FIG. 26 of the drawings, into the housing 411 is inserted a frame 423. The frame 423 comprises a pair of rectangular shaped members 424,425 linked by two pairs of guide members 426,427 and 428,429. The dimensions of the frame 423 are sufficient to fit snugly inside the housing 411. When the frame 423 is inserted into the housing 411, the guide members 426,427 are essentially mounted on the internal face of the wall 412 in parallel spaced apart relationship; the guide members 428,429 are mounted on the internal face of the wall 413 in parallel spaced apart relationship. Each of the guide members 426,427,428 and 429 comprises an inwardly projecting formation.

Projecting through the wall 412 is a plurality of electrically conductive probes. The probes are arranged in seven clusters 433–439. Similarly, on the wall 413 is a plurality of electrically conductive probes (not shown) also arranged in seven similar clusters. Each probe is connected by a respective cable (not shown) to a suitable micro-processor (not shown) and related electronics (details of which are not given here but which will be familiar to those skilled in the art). The switch means is also wired to the micro-processor and related electronics.

A key device 450, similar to the key devices previously described with reference to FIGS. 1–20 of the drawings is also shown in the drawings. However, there are some differences between the key device 450 when compared with the previously described key devices and accordingly a brief description of the key device 450 will be given here.

The key device 450 is essentially circular in plan having six indentations 451–456 and six projections 461–466 therein. On each face 470,471 of the key device 450 is a respective rhombus shaped recess 472. The recess 472 is adapted for interengagement with the guide members 426–429 when the key device 450 is inserted into the housing 411. The recess 472 is essentially divided into six segments 481–486.

The key device 450 has seven elements 491–497 and each element 491–497 has seven predetermined locations or sites (not shown). Each of the sites is adapted for the receipt of a metal pin (not shown) and depending on the number of sites occupied by a respective metal pin, each element 491–497 will have from one to seven such pins therein. The number and arrangement of such pins provides the "combination" of the key device 450.

In use, the housing 411 and associated circuitry are mounted at an appropriate location. Each of the probes of the clusters 433–439 is wired to the micro-processor. The switch means of the plunger 422 is also wired to the micro-processor. The micro-processor is appropriately programmed to respond to particular combinations of the key device 450.

With the key device 450 in the orientation shown in the drawings i.e. with the segment 486 uppermost and parallel to the top 414; the key device 450 is inserted through the slot 417 and into the housing 411. The segment 486 on each face 470,471 of the key device 450 interengages with the respective guide members 426,428. The segment 483 on each face 470,471 of the key device 450 interengages with the respective guide members 427,429. Accordingly, the guide members 426–429 maintain the key device 450 in a particular orientation.

As the key device 450 is further pushed into the housing 411, the indentation 455 makes contact with the head 423 of the plunger 422. Further insertion of the key device 450 pushes against the bias of the spring 421. When the elements 491–497 or more particularly the sites associated therewith are in register with the probes of the respective clusters 433–438, the switch means associated with the plunger 422 is actuated so as to enable the micro-processor to "read" the combination. Accordingly, the switch means should be arranged to actuate when the plunger 422 has been pushed to the left, as viewed in the drawings, a distance, on the one hand, sufficient to push the key device 450 out of the housing 411 when released and on the other hand and more particularly when the sites are in register with the probes of the clusters 433–438. When the sites are in register with the clusters 433–438, the relevant probes on the wall 412 of the housing 411 are electrically connected to the probes on the wall 413 of the housing 411 and the micro-processor "reads" the connections made. If the connections made satisfy the requirements of the programme of the micro-processor, the micro-processor outputs a signal to, for example, cause a lock of a door to open. If a key device 450 having the incorrect "combination" or if the key 450 is inserted in an incorrect orientation, then the micro-processor will fail to recognise the incorrect "combination" and the lock will remain locked.

If the same key device 450 is inserted into another housing 411 with the segments (say) 482 engaging with the projections 426,428 and the segments 485 engaging with the projections 427,428, a different combination is now presented to the other housing 411. The micro-processor having been programmed to recognise that "combination" will now actuate the lock associated therewith. The indentation 451 will act on the plunger 422 in this instance.

It will be appreciated therefore, that the key device 450 may be used in any of up to six different orientations thereby enabling six different combinations to be presented to six respective housings 411 without having to alter the configuration of any of the sites. Accordingly, a single key device 450 may be used on any one of six different locks.

With particular reference to FIG. 27 of the drawings, instead of inserting a frame 423 into the housing 411, the housing 411 per se has incorporated into the side walls 412 ,413 the projections 426,427,428 and 429. Not shown in FIG. 27 of the drawings are the clusters 433–439 or the plunger 422 and the tube 420.

I claim:

1. A key device which comprises a base notionally subdivided into a plurality of zones arranged in a predetermined pattern; each of said zones comprising an aperture for releasably receiving a respective element, the or each element having one or more sites associated therewith in a predetermined pattern; and wherein a measurable or detectable characteristic of the or each site may be selectively altered; the arrangement being such that the key device may be used in conjunction with a detector device having means for analyzing the characteristic of the or each site.

2. A key device as claimed in claim 1 wherein the base is substantially circular in plan and each zone is located on at least one face thereof.

3. A key device as claimed in claim 2 wherein the base comprises up to seven zones.

4. A key device as claimed in claim 3 wherein each zone comprises up to seven said sites.

5. A key device as claimed in claim 4 wherein each of said apertures is substantially circular in plan; each element is also circular in plan having a diameter which is slighly less than the diameter of a respective aperture; and wherein the or each element is rotatable relative to the base.

6. A key device as claimed in claim 5 wherein each of said apertures has up to seven sub-apertures arranged in a predetermined pattern therein; each of said sub-apertures having a shape or configuration associated therewith; and wherein each site includes a projection having a shape or configuration for co-operating with a respective sub-aperture.

7. A key device as claimed in claim 1 wherein each site comprises a removable pin member and wherein the characteristic of each site is altered by the presence or absence of said pin member.

8. A key device as claimed in claim 1 wherein the characteristic of each site is altered by the presence absence of a recess therein.

9. A key device as claimed in claim 1 wherein the base comprises a hub member for receiving one or more elements; and wherein each of said elements comprises one or more of said sites.

10. A key device as claimed in claim 9 wherein each of said elements is ring shaped the peripheral wall of which having one or more of said sites associated therewith in a predetermined pattern.

11. A key device as claimed in claim 10 wherein each of said elements comprises up to six sites.

12. A key device as claimed in claim 11 wherein the base comprises up to five elements.

13. A key device as claimed in claim 12 wherein each element is independently rotatable relative to the base.

14. A key device as claimed in claim 12 wherein the peripheral wall of the base carries splines and the inner peripheral wall of each element carries splines to enable non-rotatable slidable interengagment between each element relative to the base.

15. A key device as claimed in claim 1 wherein the characteristic of each site is altered by the presence or absence of an electrically conductive material.

16. A key device as claimed in claim 1 wherein the characteristic of the or each site is altered by the presence or absence of a non-electrically conductive material.

17. A key device as claimed in claim 1 when the characteristic of each site is altered by the presence or absence of a projection therein.

18. A key device as claimed in claim 1 wherein the characteristic of each site is altered by the presence or absence of a hole therein.

19. A key device as claimed in claim 1 wherein the characteristic of each site is altered by the presence or absence of a reflective surface therein.

20. A key device as claimed in claim 1 wherein the characteristic of the or each site is altered by the presence or absence of a magnetic material.

21. A key device as claimed in claim 1 wherein the characteristic of each site is altered by the presence or absence of a non-magnetic material.

22. A key device as claimed in claim 1 for use in actuating a locking device.

23. A detector device for use with a key device as claimed in claim 1 which device comprises a base; means associated with the base for determining the characteristic of each site of the key device; and means for providing a micro-processor means with the pattern of characteristics of the key device.

24. A detector device for use with a key device as claimed in claim 1 which device comprises a housing; a guide means located in the housing for guiding said key device when inserted therein; and an opening in the housing for receiving said key device, said key device having a complementary guide means thereon for interengaging with the guide means of the housing to enable said key device to be inserted into the housing in a predetermined orientation; and means operatively associated with the housing for actuating said detector means.

* * * * *

UNITED STATES PATENT AND TRADEMARK OFFICE

CERTIFICATE OF CORRECTION

PATENT NO. : 4,872,329

DATED : October 10, 1989

INVENTOR(S) : James Joseph Byrne

It is certified that error appears in the above-identified patent and that said Letters Patent is hereby corrected as shown below:

Column 10, line 55, "218" should read --218a--;

Column 11, line 5, "218" should read --218a--;

Column 15, line 25, delete "the or";

Column 16, line 14, delete "the or";

Column 16, line 27, delete "the or";

Signed and Sealed this

Second Day of April, 1991

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,872,329

DATED : October 10, 1989

INVENTOR(S) : James Joseph Byrne

It is certified that error appears in the above-identified patent and that said Letters Patent is hereby corrected as shown below:

Title page, Column 1, under "Inventor James J. Byrne, Edenderry, Ireland" insert --Assignee: Glensesk Ltd., Dublin, Ireland--.

Signed and Sealed this

Ninth Day of February, 1993

*Attest:*

STEPHEN G. KUNIN

*Attesting Officer*

*Acting Commissioner of Patents and Trademarks*